US005251994A

United States Patent [19]

Strässle

[11] Patent Number: 5,251,994

[45] Date of Patent: Oct. 12, 1993

[54] DEVICE FOR A CONNECTION ELEMENT

[75] Inventor: Marcel Strässle, Kirchberg, Switzerland

[73] Assignee: Syma Intercontinental S.A., Kirchberg, Switzerland

[21] Appl. No.: 752,490

[22] PCT Filed: Feb. 13, 1991

[86] PCT No.: PCT/CH91/00040

§ 371 Date: Sep. 10, 1991

§ 102(e) Date: Sep. 10, 1991

[87] PCT Pub. No.: WO91/12384

PCT Pub. Date: Aug. 22, 1991

[30] Foreign Application Priority Data

Feb. 16, 1990 [CH] Switzerland ..... 507/90-8

[51] Int. Cl.[5] ..... F16B 7/00

[52] U.S. Cl. ..... 403/171; 403/176

[58] Field of Search ..... 403/170–172, 403/176, 405.1, 22, 11, 173, 174, 264, 260, 262, 258, 341, 12; 52/648

[56] References Cited

U.S. PATENT DOCUMENTS

| | | | |
|---|---|---|---|
| 3,914,060 | 10/1975 | Miller et al. | 403/171 |
| 3,982,841 | 9/1976 | Endzweig | 403/171 X |
| 4,438,615 | 3/1984 | Wendel | 52/648 |
| 4,677,804 | 7/1987 | Holt | 52/648 |
| 4,789,264 | 12/1988 | Galan Inchaurbe | 403/171 X |
| 4,822,199 | 4/1989 | Nehls | 403/171 |
| 4,848,952 | 7/1989 | Strässle | 403/171 |
| 4,872,779 | 10/1989 | Imai | 403/176 X |

FOREIGN PATENT DOCUMENTS

| | | | |
|---|---|---|---|
| 297033 | 12/1988 | European Pat. Off. . | |
| 2582361 | 11/1986 | France | 52/648 |
| 539924 | 2/1956 | Italy | 403/171 |
| 676701 | 8/1979 | U.S.S.R. | 403/171 |
| 2131847 | 6/1984 | United Kingdom | 52/648 |

*Primary Examiner*—Randolph A. Reese
*Assistant Examiner*—Harry C. Kim
*Attorney, Agent, or Firm*—Sughrue, Mion, Zinn, Macpeak & Seas

[57] ABSTRACT

A guide device including a bolt (5) which through a sleeve insert can be fastened rotatably to one end of a rod (21), which bolt is connected, sliding axially, to the front part of a guide sleeve (16') in such a way that a rotary movement of the guide sleeve (16') can be transmitted to the bolt (5). A spring (20) pushes the bolt (15) out of the guide sleeve (16'), and the rear end of the guide sleeve (16') an approximately bell-shaped flange (17) is provided, which delimits an inside space which is dimensioned such that the head (1) of the sleeve insert can be accommodated therein.

11 Claims, 2 Drawing Sheets

DEVICE FOR A CONNECTION ELEMENT

FIELD OF THE INVENTION

The present invention relates to a guide device for a connection element.

BACKGROUND OF THE INVENTION

A device of this general type is known from the European Patent Application No. EP-A2-0 297 033.

SUMMARY OF THE INVENTION

It is the object of the invention to create a different type of guide device than the device disclosed in the above-mentioned European Patent Application.

The present invention provides a guide device for a connection element including a bolt which by means of a sleeve insert, can be rotatably fastened to an end of a rod. The bolt is connected slidably axially to the front part of a guide sleeve so that rotary movement of the guide sleeve can be transmitted to the bolt. A bell-shaped flange is at a rear part of the guide sleeve which serves to define an inside space which is dimensioned as that a head of the sleeve insert can be disposed therein.

BRIEF DESCRIPTION OF THE DRAWINGS

The invention will be explained in greater detail by a description of exemplified embodiments with reference to the drawings; wherein.

DETAILED DESCRIPTION OF THE PREFERRED EMBODIMENTS

Figure 1:
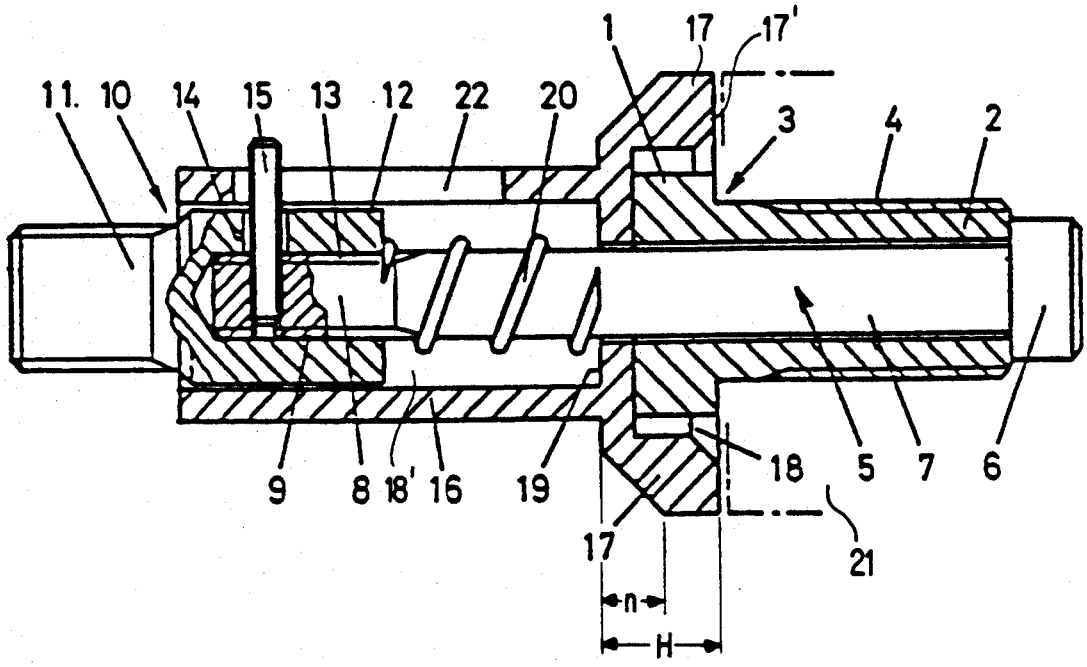
FIGS. 1 to 3 show diagrammatic sectional views of various connection elements with various variants of the device according to the invention.

The connection element according to FIG. 1 comprises a sleeve insert 3 consisting of a flange-shaped sleeve head 1 and a tubular part 2, wherein the tubular part 2 is provided with an external thread 4 for fastening it to one end of a rod of a three-dimensional framework. A bolt 5 is guided through a through-bore of the sleeve insert 3, the head 6 of the bolt 5 resting on the end wall of the tubular part 2.

Figure 4:
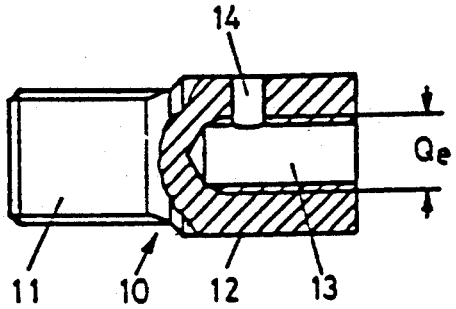
FIGS. 4 and 5 show views of a guide insert for the guide sleeve according to FIG. 2.

The bolt 5 has an elongated, round, smooth part 7 and an end part 8 which is provided with an external thread 9 for fastening the bolt to a guide insert 10 (FIG. 4).

FIG. 4 shows a side sectional view transversely to the longitudinal axis of the guide insert 10 with a threaded part 11 which serves to screw it onto a junction part.

The guide insert 10 has on one side thereof a hexagonal part 12 (FIG. 5) with a threaded bore 13, into which the threaded bolt can be screwed. Approximately in the middle of the shell of the guide part 12, a perpendicular threaded hole 14 is provided, through which a threaded pin 15 shown in FIG. 1, e.g. a hegaxonal socket pin, can be screwed on to guide the guide insert 10 in the assembled state.

The bolt 5 is guided through the through-bore of a guide device or guide sleeve 16, from which the threaded part 11 of the guide insert 10 projects. At the front part of the guide sleeve 16 this through-bore is shaped complementally to the guide part 12, so that a rotary movement of the guide sleeve 16 can be transmitted to the threaded part 11 with as little play as possible.

Figure 5:
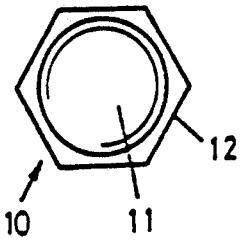

The through-bore of the front part of the guide sleeve 16 can, therefore, also be polygonal, the same as the guided part of the guide insert. However, these cross-sections are preferably hexagonal, as illustrated in FIGS. 4 and 5. In contrast thereto the guide sleeve 16 is, in its rear part, made flange-shaped towards the outside and rear, to form an approximately bell-shaped flange 17, in the inside space 18 of which the sleeve head 1 can be accommodated. As shown in FIG. 1, the flange 17 includes a bevel 17', and a height h is more than half (50%) of the total height H. In addition, the guide sleeve 16 has in its rear part a radially arranged ring-shaped wall 19, wherein in the inside space of the guide sleeve 16 between the wall 19 and the guide insert 10 a coil spring 20 is arranged around the bolt 5, which spring 20 presses the guide insert 10 and the bolt 5 connected thereto forwards. Further, guide sleeve 16 includes an inside space 18'.

The maximum outside diameter of the flange 17 is preferably the same as the outside diameter of the rod 21 to be connected by the connection element, so as to obtain a pleasing aesthetic effect, and the minimum inside diameter of the flange 17 in the bell-shaped space is greater than the maximum cross-section of the sleeve head 1, which preferably is not round, so that it can be screwed onto the rod 21 by means of a spanner. The diameter of the bore of the ring-shaped wall 19 is larger than the diameter of the bolt 5 and smaller than the diameter of the coil spring 20. The sleeve 16 according to FIG. 1 has an opening 22, through which the pin 15 is guided.

The mode of operation of the element according to FIG. 1 is basically known from the European Patent Application No. 297.033 with the difference that according to the present invention in its rear part, the guide sleeve 16 is constructed differently. The flange-shaped construction has the advantage that the transition between the end of the rod 21 and the sleeve 16 can be realized harmonically, and this in various variants, as, for example, on the outside the front part of the guide sleeve 16 may be hexagonal and the flange 17 round.

Figure 2:
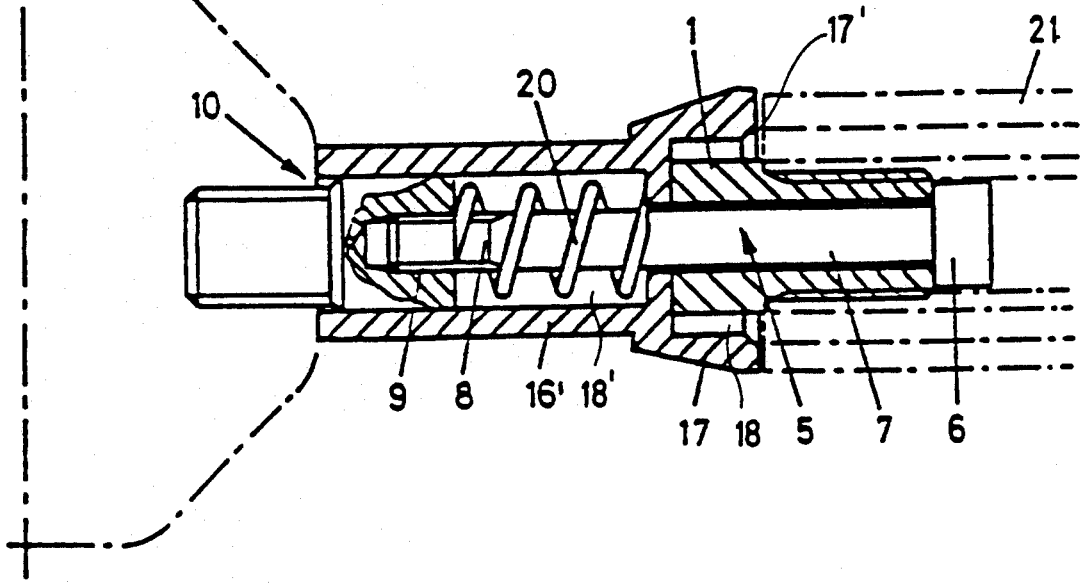

The connection element according to FIG. 2 corresponds essentially to the embodiment of FIG. 1, wherein for identical parts the same reference numerals are used. However, with this embodiment the guide device or sleeve 16' does not have an opening in its shell.

Figure 3:
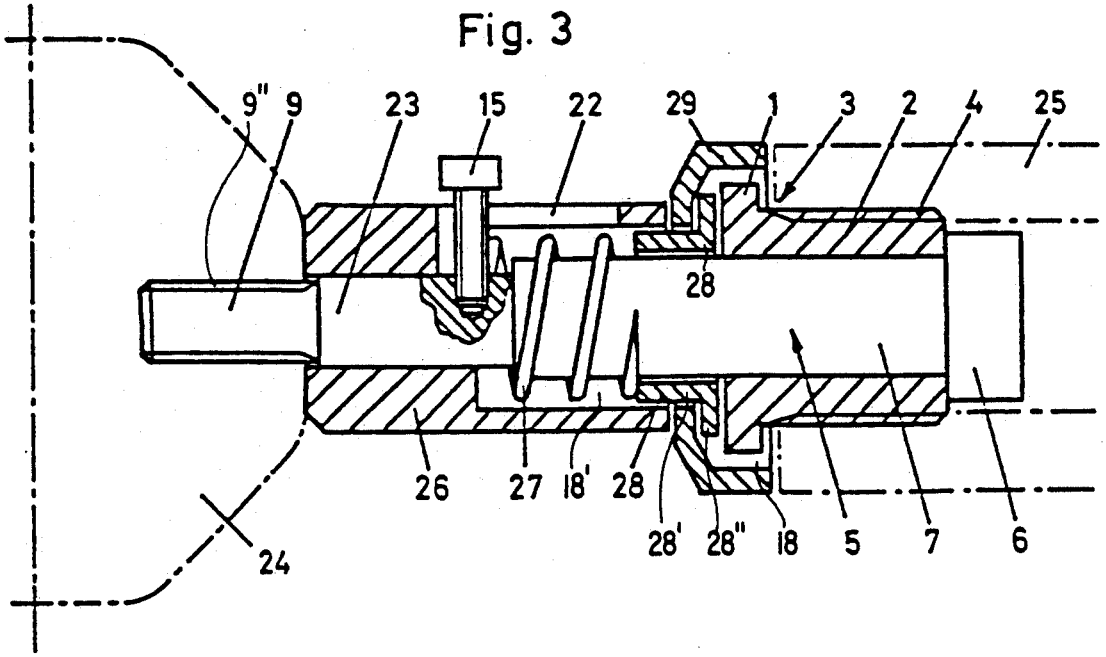

The connection element according to FIG. 3 has a few characteristics in common with the embodiment of FIG. 1, and also here the same reference numerals are used for identical parts. The connection element according to FIG. 3 comprises, in particular, also a sleeve insert 3 consisting of a sleeve head 1 and a tubular part 2, wherein the tubular part 2 is provided with an external thread 4. Through a through-bore of the sleeve insert 3 a bolt 5' is guided, the head 6 of which rests on the end face of the tubular part 2.

The bolt 5' has an elongated, round, smooth part 7', a guide part 23, the cross-section of which may be polygonal, and an end part 9' which is provided with an external thread 9''. To simplify the drawing, the junction part 24 and the rod 25 are indicated only by broken lines.

The bolt 5' is guided through the through-bore of a guide sleeve 26, from which the end part 9' projects. In the front part of the guide sleeve 26 this through-bore is shaped complementally to the guide part 23 of the threaded bolt 5', so that a rotary movement of the guide sleeve 26 can be transmitted to the bolt 5' with as little play as possible.

The through-bore of the front part of the guide sleeve 26 can, therefore, also be polygonal, the same as the guided part of the bolt 5'. However, preferably these cross-sections are hexagonal. In contrast thereto the through-bore has in the rear part of the guide sleeve 26 a preferably round cross-section, in which case there occurs between the round part 7' of the bolt 5' and the preferably cylindrical inside wall of the guide sleeve 26 a relatively large gap, to form an open space in which a coil spring 27 can be accommodated.

In the shell of the guide sleeve 26 an elongated opening 22 may be provided through which a pin 15 can be loosely inserted and connected to the bolt 5', preferably radially in its guide part 8.

The spring 27 is arranged in the gap in such a way that at its end on the right it rests on a bush 28 having a cylinder part 28' and a flange part 28'' and at its end on the left it rests on the pin 15 to press it forward and with this push the end part 9' out of the guide sleeve 26, when it is, for example, pushed by hand into the guide sleeve 26. The transmitting of the rotary movement is ensured by the shape of the front part of the guide sleeve 26. On the other hand the pin 15 is provided so that the bolt 5' can be pushed with the fingers along the elongated opening 22 against the action of the spring 27.

With this embodiment the bell-shaped flange 29 is separate from the actual guide sleeve 26, and the bush 28 is provided to fasten the flange 29 to the guide sleeve 26, e.g. by screwing or by a bayonet connection. In this case the flange 29, the bush 28 and the guide sleeve 26 form the guide device for the connection element.

The embodiment according to FIG. 3 has the property that the spring 27 no longer remains constantly clamped-in in the sleeve 26 if this is closed off, e.g. by screwing on the bush 28. The spring 27 can, therefore, easily be removed from the sleeve 26. This property is often desirable so that the spring 27 can be replaced more easily. In addition to this advantage, the connection element of FIG. 3 has the further advantage that due to the bell-shaped flange 29 a well matching transition can be realized between the rod 25 and the guide sleeve 26. This embodiment can be made without any opening 22 whatsoever in the shell of the guide sleeve 26, as it can be dismantled very easily. Instead of the pin, a projection of the bolt in the parts 7 and/or 23 could be provided, in which case the opening 22 could also be provided right up to the rear end of the guide sleeve 26.

In a further development of the invention, the flange 29 could form an integral part with the rear end of the guide sleeve 26.

In a further development of the invention, the flange 29 could form an integral part with the bush 28.

Finally, it must still be pointed out that instead of a coil spring it is also possible to use a spring that is put on from the side, e.g. a meander-shaped spring, and that with a view to maintaining the tolerances the flange ring and/or the sleeve may also be made from die cast metal, e.g. as bronze or zinc die castings.

I claim:

1. A device for connecting a rod (21) to a junction, the device comprising:

a bolt (5) having a threaded part (11) for fastening said bolt to the junction;

a sleeve insert (3) having a head (1) integral with a tubular part (2), said sleeve insert (3) rotatably fastening said bolt (5) to an end of the rod (21), thereby allowing axial movement of the bolt (5);

a guide sleeve (16, 16') having a front part and a rear part, said bolt (5) having a sliding means (10) for allowing said bolt to be connected, slidably axially, to the front part of said guide sleeve (16, 16') so that rotary movement of said guide sleeve is transmitted to said bolt (5);

an approximately bell-shaped flange (17) formed as one piece with said guide sleeve (16, 16') at a rear part thereof, said bell-shaped flange (17) defining an inside space (18) having a transverse dimension which is greater than that which would be necessary to accommodate the head (1) of said sleeve insert (3) therein, so that there is an open space (18) between external lateral surfaces of said head (1) and internal lateral surfaces of said flange delimiting said inside space (18), said guide sleeve and bell-shaped flange (17) being rotatable relative to the head (1) of said sleeve insert (3).

2. The device as defined in claim 1, wherein the bell-shaped flange (17) has a bevel (17') delimiting the flange inside space (18) at an opening hiding said head (1) of said sleeve insert (3).

3. The device as defined in claim 1, wherein said head (1) has a shape which allows it to be screwed onto the rod (21).

4. The device as defined in claim 1, wherein the outer surface of the bell-shaped flange (17) is continuous.

5. The device as defined in claim 1, wherein the bell-shaped flange (17) includes a wall (19) which forms a partition between the flange inside space (18) and a second inside space (18') of the guide sleeve (16, 16'), and wherein said wall (19) has a through-bore whose diameter is slightly larger than a maximum diameter of the bolt (5).

6. The device as defined in claim 1, wherein an outside portion of said bell-shaped flange (17) has a conical shape, wherein the rod (21) has a circumference which is larger than a circumference of said guide sleeve (16, 16'), and wherein said conical-shaped outside portion of said flange (17) adapts the larger circumference of the rod (21) to the smaller circumference of said guide sleeve (16, 16').

7. The device as defined in claim 1, wherein said head (1) has a shape which allows it to be screwed onto the rod (21), and wherein the bell-shaped flange (17) has a bevel (17') delimiting the flange inside space (18) at the opening hiding said head (1) of said sleeve insert (3).

8. The device as defined in claim 1, wherein the bell-shaped flange (17) has a bevel (17') delimiting the flange inside space (18) at the opening hiding said head (1) of said sleeve insert (3), wherein the bell-shaped flange (17) includes a wall (19) which forms a partition between said inside space (18) and a second inside space (18') of the guide sleeve (16, 16'), and wherein said wall 19 has a through-bore whose diameter is slightly larger than a maximum diameter of the bolt (5), wherein an outside portion of said bell-shaped flange (17) has a conical shape for a rod (21) having a circumference which is larger than a circumference of said guide sleeve (16, 16'), and wherein said conical-shaped outside portion of said flange (17) adapts the larger circumference of the rod (21) to the smaller circumference of said guide sleeve (16, 16'), wherein an end part (8) of the bolt (5) is provided with an external thread (9) for fastening the bolt to a guide insert (10) having a polygonal cross-section, wherein the cross-section of the through-bore of the guide sleeve (16; 16') is polygonal and complementally to the guide insert (10), so that a rotary movement of the guide sleeve (16; 16') is transmitted to the threaded part (11) of the guide insert (10) and wherein a coil spring (20) is disposed in said second inside space (18') and between said wall (16) and said guide insert (10).

9. A device for connecting a rod (25) to a junction, the device comprising:

a bolt (5');

a sleeve insert (3) having a head (1) integral with a tubular part (2), said sleeve insert (3) rotatably fastening said bolt (5') to an end of the rod (25);

a guide sleeve (26) having a front part and a rear part, said bolt (5') being connected, slidably axially, to the front part of said guide sleeve (26) so that rotary movement of said guide sleeve is transmitted to said bolt (5');

an approximately bell-shaped flange (29) integrally connected with said guide sleeve (26) at the rear part thereof, so that said flange (29) and said guide sleeve (26) are rotatable relative to the head of said sleeve insert (3);

said bell-shaped flange (29) delimiting an inside space (18) having a transverse dimension which is greater than that which would be necessary to accommodate the head (1) of said sleeve insert (3) therein so that there is an open space (18) between external lateral surfaces of said head (1) and internal lateral surfaces of said inside space;

wherein a bush (28) is coaxially inserted in a central opening of said bell-shaped flange (29), said bush (28) including a cylinder part (28') and a flange part (28'') adapted to rest on an internal surface of said bell-shaped flange (29);

wherein said bush (28) forms a partition between the flange inside space (18) and a second inside space (18') of the guide sleeve (26), wherein said bush (28) has a through-bore whose diameter is slightly larger than a maximum diameter of the bolt (5'), wherein the bolt (5') has a first round part (7'), a second guide part (23) having a polygonal cross-section, and a third end part (9');

wherein a diameter of the first part (7') is not less than an overall diameter of the second part (23), wherein a minimum diameter of the second part (23) is not less than a maximum diameter of the third part (9'), wherein the third part (9'') of the bolt (5') is provided with an external thread (9') for fastening the bolt (5') to a junction part (24);

wherein a cross-section of the through-bore of the guide sleeve (26) is polygonal and complementally to the polygonal cross-section of said second part (23) of the bolt (5') so that rotary movement of the guide sleeve (26) is transmitted to the bolt (5') through said second part (23).

10. The device as defined in claim 9, wherein an outside portion of said bell-shaped flange (29) has a conical shape for a rod (25) having a circumference which is larger than a circumference of said guide sleeve (26), and wherein said conical-shaped outside portion of said flange (29) adapts the larger circumference of the rod (25) to the smaller circumference of said guide sleeve (26).

11. The device as defined in claim 10, wherein said guide sleeve (26) includes a lateral slot opening (22) parallel to an axis of the bolt (5') for receiving a pin (15) connected to the bolt (5'), and wherein a coil spring (27) is disposed in said second inside space (18') and between said bush (28) and said pin (15).

* * * * *